United States Patent [19]

Ishioka et al.

[11] 4,380,557

[45] Apr. 19, 1983

[54] METHOD OF PRODUCTION OF IMAGE PICKUP DEVICE

[75] Inventors: Sachio Ishioka, Tokyo; Yasuharu Shimomoto, Hinodemachi; Yoshinori Imamura, Hachioji; Saburo Ataka, Hinodemachi; Yasuo Tanaka, Kokubunji; Hirokazu Matsubara, Hamuramachi; Yukio Takasaki, Hachioji; Eiichi Maruyama, Kodaira, all of Japan

[73] Assignee: Hitachi, Ltd., Tokyo, Japan

[21] Appl. No.: 287,554

[22] Filed: Jul. 28, 1981

[30] Foreign Application Priority Data

Jul. 28, 1980 [JP] Japan ..... 55-102529

[51] Int. Cl.[3] ..... B05D 3/02; B05D 3/04

[52] U.S. Cl. ..... 427/38; 204/192 P; 427/39; 427/74

[58] Field of Search ..... 427/38, 39, 74; 204/192 P

[56] References Cited

U.S. PATENT DOCUMENTS 4,196,438 4/1980 Carlson ..... 427/39 X 4,237,150 12/1980 Wiesmann ..... 427/74

*Primary Examiner*—James R. Hoffman

*Attorney, Agent, or Firm*—Antonelli, Terry & Wands

[57] ABSTRACT

In preparing an image pickup device by using hydrogen-containing amorphous silicon for a photoconductive layer, a hydrogen-containing amorphous silicon layer is first formed and is then heat-treated at 100° to 300° C. The image pickup characteristics of the amorphous silicon layer are highly improved by this heat treatment. For example, the lag and dark current are reduced and the signal current-target voltage characteristic is improved. Especially excellent improving effects can be obtained when amorphous silicon characterized in that (1) the hydrogen content is 5 to 30 atomic %, (2) the optical forbidden band gap is 1.30 to 1.95 eV and (3) in the infrared absorption spectrum, the component of a wave number of 2000 $cm^{-1}$ is observed larger than the component of a wave number of 2100 $cm^{-1}$ is subjected to the above-mentioned heat treatment. The adhesion to the substrate is enhanced, and good image pickup characteristics can be obtained.

6 Claims, 8 Drawing Figures

METHOD OF PRODUCTION OF IMAGE PICKUP DEVICE

BACKGROUND OF THE INVENTION (1) Field of the Invention

The present invention relates to an improvement in the method of producing an image pickup device by using amorphous silicon.

(2) Description of the Prior Art

Hydrogen-containing amorphous silicon has a photoconductivity and a homogeneous, large-area film can be obtained therefrom under low temperature conditions. Accordingly, a trial has been made to prepare a light-sensitive screen applicable to photo-electric conversion devices from hydrogen-containing amorphous silicon, as proposed in the specification of U.S. Pat. No. 4,255,686.

According to this trial, devices having a high sensitivity to rays of the visible ray region can be obtained, but when an amorphous silicon layer prepared by sputtering in a hydrogen atmosphere or glow discharge of a silane gas is directly used as a light-sensitive screen, the yield of devices having stable characteristics is low. Furthermore, under some film-preparing conditions, only devices having insufficient characteristics are obtained. Therefore, these disadvantages inhibit actual production of image pickup devices.

SUMMARY OF THE INVENTION

The present invention provides an improved method of the production of image pickup devices, in which image pickup characteristics of hydrogen-containing amorphous silicon are highly improved.

When a hydrogen-containing amorphous silicon layer prepared by sputtering in a hydrogen-containing gas or glow discharge of a silane gas is heat-treated at a temperature of from 100° to 300° C., the photoelectric characteristics of the layer can highly be improved.

Formation of a hydrogen-containing amorphous silicon layer on a substrate can be performed according to known methods.

The above-mentioned heat treatment is effective for improving the characteristics of ordinary hydrogen-containing amorphous silicon layers, but especially excellent effects can be attained when a hydrogen-containing amorphous silicon layer having the following specific properties (1) through (3) is used and this layer is heat-treated at a temperature of from 100° to 300° C. Furthermore, in this case, the adhesion of the silicon layer to the substrate is enhanced and peeling does not take place at all.

(1) The amorphous silicon layer contains hydrogen in an amount of 5 to 30 atomic %.

(2) The optical forbidden band gap is in the range of from 1.30 eV to 1.95 eV.

(3) In the infrared absorption spectrum, the component of a wave number of 2000 $cm^{-1}$ is observed larger than the component of a wave number of 2100 $cm^{-1}$. If the component of a wave number of 2100 $cm^{-1}$ is less than 80% of the component of a wave number of 2000 $cm^{-1}$, preferred characteristics are manifested, and if the component of a wave number of 2100 $cm^{-1}$ is less than 50% of the component of a wave number of 2000 $cm^{-1}$, especially preferred characteristics are obtained.

It is important that the hydrogen content of amorphous silicon should be 5 to 30 atomic % as pointed out above and be preferably 7 to 25 atomic %. If the hydrogen content is too low or too high, the photoconductivity is drastically reduced.

It is preferred that the optical forbidden band gap of amorphous silicon be in the range of from 1.30 eV to 1.95 eV.

DETAILED DESCRIPTION OF THE PREFERRED EMBODIMENTS

The present invention will now be described in detail with reference to an image pickup tube as a typical instance of the photoelectric conversion device. In the image pickup tube, it is preferred that a high-level signal be obtained at a low target voltage applied and the level of the dark current be as low as possible when no light is applied. Furthermore, it is preferred that after stopping of application of light, the signal current should decay as promptly as possible. However, the characteristics of the image pickup tube are greatly influenced by the physical characteristics of amorphous silicon used as a light-sensitive screen. Hydrogen is contained in amorphous silicon that is used as a photoelectric screen, and the optical and electric characteristics of the layer of amorphous silicon are determined by the amount and bond state of hydrogen contained in amorphous silicon.

The optical forbidden band gap of amorphous silicon depends on the composition and structure of the material, especially the hydrogen content. However, even if the hydrogen content is the same, there appear two different states of the optical forbidden band gap as shown in Table 1.

TABLE 1

| No. | Hydrogen Content (atomic %) | Optical Forbidden Band Gap (eV) First State | Optical Forbidden Band Gap (eV) Second State |
|---|---|---|---|
| 1 | 5 | 1.3 | 2.3 |
| 2 | 10 | 1.45 | 2.0 |
| 3 | 15 | 1.55 | 1.95 |
| 4 | 20 | 1.60 | 1.90 |

The reason why such two different states are brought about has not been elucidated sufficiently.

Figure 1:
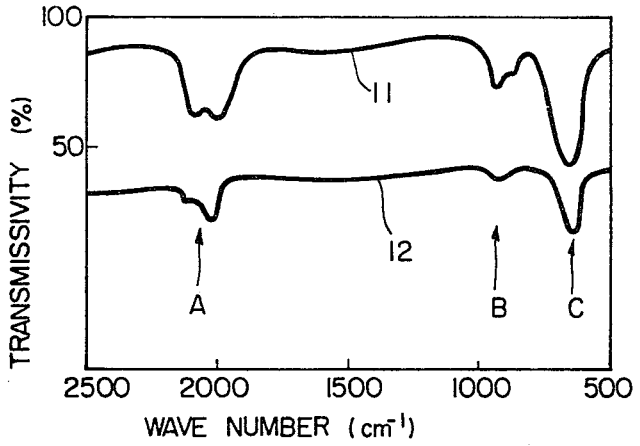
FIG. 1 is a diagram showing the infrared absorption spectrum of hydrogen-containing amorphous silicon.

Infrared absorption spectrum curves of hydrogen-containing amorphous silicon samples are shown in FIG. 1. The determination of the infrared absorption spectrum is effective as means for examining the bonding state of hydrogen and silicon in the amorphous material. The observed peaks of the infrared absorption spectrum are those due to the stretching vibration mode, bending vibration mode and wagging or rocking vibration mode of the hydrogen-silicon bond. The peaks A, B and C correspond to the peaks of the above-mentioned three modes. The stretching vibration mode is in the form of an absorption spectrum curve having branched peaks at wave numbers of about 2000 $cm^{-1}$ and about 2100 $cm^{-1}$, respectively. Curve 11 shows an instance in which both the peaks are substantially equal in the magnetude and curve 12 shows an instance in which the peak at 2000 $cm^{-1}$ is larger than the peak at 2100 $cm^{-1}$.

These two peaks correspond to two difference states of the hydrogen-silicon bond. Hydrogen-containing amorphous silicon in which the component of a wave number of 2000 $cm^{-1}$ is observed larger than the component of a wave number of 2100 $cm^{-1}$ is very excellent in the adhesion to various substrates, and a layer from such amorphous silicon is ordinarily obtained in the form of a mirror plane film.

However, a hydrogen-containing amorphous silicon layer as-prepared by reactive sputtering or the like is not stable in characteristics and most samples are defective in that (1) the signal current of the image pickup tube is inferior to rising with respect to the applied voltage, (2) the dark current is large and (3) the lag characteristic is inferior. From the industrial viewpoint, it is important to manufacture large quantities of samples uniform in the characteristics.

It has been found that when such hydrogen-containing amorphous silicon layer is heat-treated at a temperature of from 100° to 300° C., the characteristics are remarkably improved.

Figure 2:
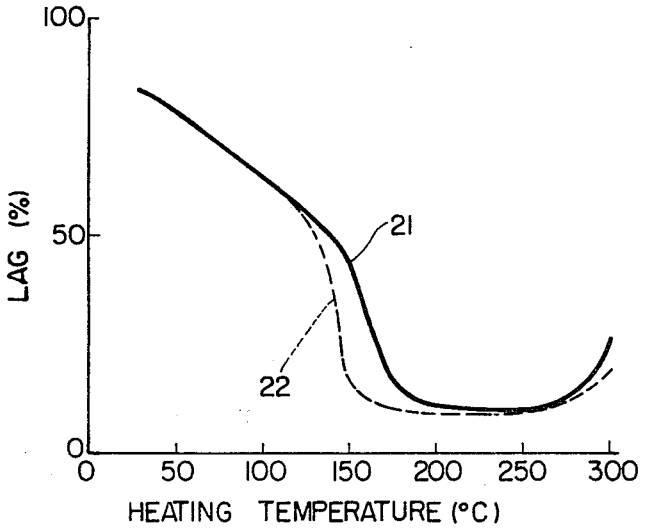
FIG. 2 is a diagram illustrating the relation between the heating temperature in vacuum and the lag characteristic of the resulting image pickup tube.
Figure 3:
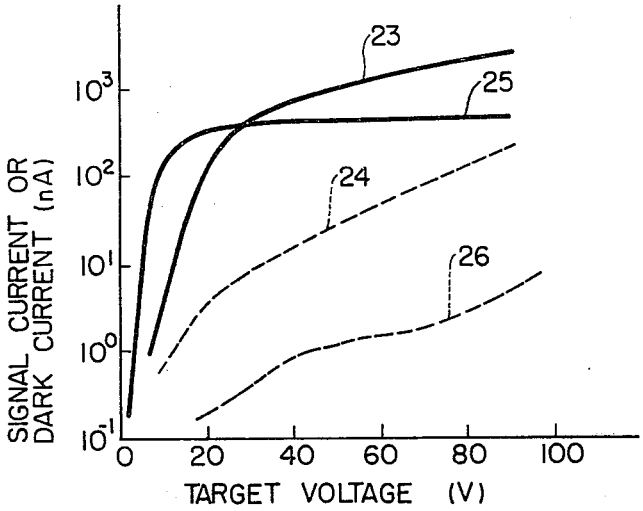
FIG. 3 is a graph illustrating the current-voltage characteristic of the image pickup tube.

FIGS. 2 and 3 are diagrams of characteristics of the image pickup tube, which illustrate the results obtained when a hydrogen-containing amorphous silicon layer having initial characteristics shown in Table 2 is heat-treated. More specifically, FIG. 2 illustrates the relation between the lag characteristic of the image pickup tube and the heating temperature in vacuum. The indicated values are those obtained after 3 fields from interception of light. Curve 21 shows the results obtained when the heating time is 15 minutes and curve 22 shows the results obtained when the heating time is 90 minutes.

TABLE 2

| | |
|---|---|
| (peak)2000/(peak)2100 | higher than 1 |
| signal current (nA) at 10 luxes irradiation | 1000 |
| dark current (nA) | 20 |
| lag (%) (after 50 seconds) | 85 |
| after-image | more than 1 minute |
| film thickness (μm) | 2 |
| hydrogen content (atomic %) | 7 |
| optical forbidden band gap (eV) | 1.7 |

Note
The target voltage is 50 V.

A certain improvement of the characteristics is observed even if the heating temperature is 100° C., but the improving effect is especially prominent when the heating temperature is higher than 150° C. However, if the heating temperature is 300° C., slight degradation of the characteristics is observed. When the heating temperature is 300° C., deterioration of the layer is initiated by dissociation of hydrogen. Accordingly, in the present invention the upper limit of the heating temperature is 300° C. The time of the above heat treatment is 15 minutes. If the heat treatment time is prolonged, the film quality is further improved. For example, when the heat treatment is carried out at 150° C. for 15 minutes, the lag is about 45% as shown in FIG. 2. If the heat treatment is conducted for 90 minutes at the same temperature, the lag is reduced to about 15%. However, this improvement is attained only when the heat treatment temperature is 150° C. or higher. For example, even if the heat treatment is conducted at 100° C. for 90 minutes, such improvement as attained at 150° C. is not attained at all. Accordingly, it is more preferable that the heat treatment temperature be at least 150° C. for attaining a prominent effect by the heat treatment.

The above-mentioned heat treatment should be conducted after discharge for formation of the layer has been stopped. Even if the substrate temperature is maintained at 250° C. during discharge, no effect can be attained.

The improvement of the characteristics by the heat treatment can be attained irrespectively of the ambient atmosphere. Namely, the effect of improving the characteristics can similarly be attained in any of atmospheres such as inert gas, hydrogen gas, oxygen gas and air. However, in connection with the lag characteristic, it has been found that best results are obtained when the heat treatment is carried out in vacuum of 0.1 Torr or less.

FIG. 3 illustrates the current-voltage characteristic of the image pickup tube, in which the solid line indicates the signal current and the dot line indicate the dark current. The results obtained when as-prepared amorphous silicon is directly used are shown by curves 23 and 24. In this case, the signal current is influenced by the injection current component and the signal current gently rises, and the dark current is large. The results obtained when amorphous silicon is heat-treated at 250° C. for 15 minutes in vacuum are shown by curves 25 and 26. In this case, the signal current quickly rises and shows a good saturation characteristic, and the dark current is reduced to a level less than 1/10 of the level in the above-mentioned case. This improvement is prominent when the heat treatment temperature is about 150° C. or higher, but if the heat treatment temperature is 300° C., degradation of the sensitivity due to deterioration of the layer is similarly observed.

Also in connection with the after-image, if the heat treatment is carried out according to the present invention, an improving effect can be attained. More specifically, the after-image is shorter than 1 second and such value is of no significance from the practical viewpoint.

The heat treatment of the present invention is carried out after discharge has been stopped, and if the sample temperature is elevated to the above-mentioned level during the discharge treatment, no improvement of the characteristics can be attained.

The present invention will now be described in detail with reference to the following Examples that by no means limit the scope of the invention.

EXAMPLE 1

The method of producing a photoconductive layer according to the present invention will now be described with reference to an embodiment in which the photoconductive film is used as a photoconductive film of a target of an image pickup tube.

Figure 4:
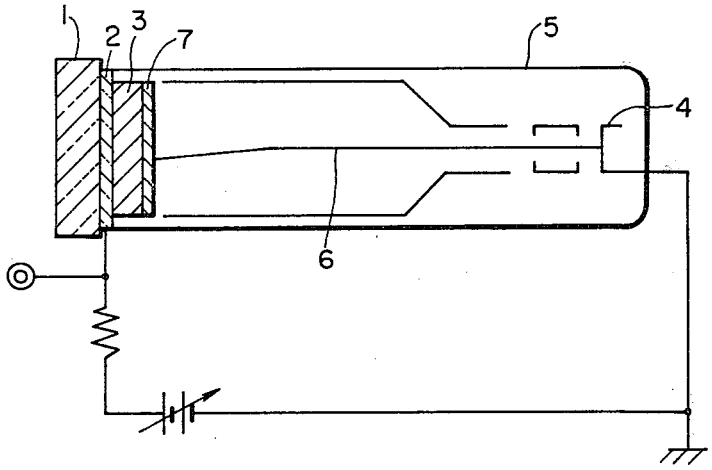
FIG. 4 is a diagram illustrating the section of the image pickup tube.

As a typical instance of the conventional light-receiving device used in the storage mode, there can be mentioned a photoconductive type image pickup tube shown in FIG. 4. This image pickup tube comprises a light-transmitting substrate 1 called "face plate", a transparent conductive film 2, a photoconductor layer 3, an electron gun 4 and a package 5. A light image formed on the photoconductor layer 3 through the face plate 1 is subjected to photoelectric conversion and accumulated as a charge pattern on the surface of the photoconductor layer 3. The accumulated charge pattern is read by the time series method using scanning electron beams 6.

The present invention is applied to the abovementioned photoconductor.

An optically polished glass sheet having transparent electrodes of tin oxide or the like formed thereon is used as the substrate on which an amorphous silicon film is to be deposited. This substrate is placed and set in a sputtering apparatus so that it confronts a silicon target as the starting material.

Figure 5:
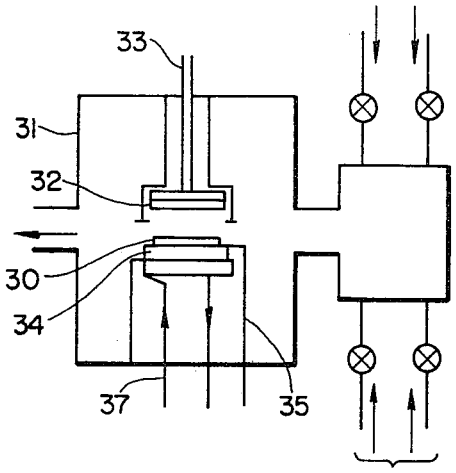
FIG. 5 is a diagram illustrating the sputtering apparatus.

FIG. 5 is a diagram illustrating the sputtering apparatus. Reference numerals 30 and 31 represent a sample and a vessel that can be evacuated to vacuum. A sintered silicon body or the like is used as a sputtering target. Reference numerals 33, 34, 35, 36 and 37 represent an electrode for applying a voltage rf, a sample holder, a temperature-measuring thermocouple, a passage for introduction of a rare gas such as argon and hydrogen and a passage for introduction of cooling water, respectively. A hydrogen-containing amorphous silicon film is prepared in a mixed gas of the rare gas and hydrogen according to the reactive sputtering method using a sputtering apparatus. A magnetron type low-temperature high-speed sputtering apparatus is suitable as the sputtering apparatus. When an amorphous film contains hydrogen and film is heated at a temperature higher than 300° C., ordinarily, hydrogen is released and deterioration of the film is caused. Accordingly, it is preferred that the substrate temperature be maintained at 100° to 300° C. during the film-forming operation. The hydrogen concentration in the amorphous film can be changed within a range of from about 2% to about 20% while maintaining the pressure of the atmosphere at $5\times10^{-4}$ to $1\times10^{-2}$ Torr during the discharge operation. A sintered silicon body is used as the sputtering target. If necessary, boron as a p-type impurity or phosphorus as an n-type impurity may be incorporated into the sintered body, or a sintered mixture of silicon and germanium may be used.

The vessel 31 that can be evacuated to vacuum is evacuated to about $1\times10^{-6}$ Torr where the influence of the residual gas can be neglected, and a mixed gas of hydrogen and argon is introduced into the vessel 31 so that the vacuum degree in the vessel is $5\times10^{-4}$ Torr to $1\times10^{-2}$ Torr. The partial pressure of hydrogen is 10%. In this state, a high frequency power of about 300 W (the frequency is 13.56 MHz) is applied to the target. Discharge is caused between the target and the substrate, and amorphous silicon is deposited on the substrate. The substrate temperature is adjusted to 150° to 250° C. at this step. If the hydrogen concentration is lower than 20% in the mixed gas, the deposited amorphous silicon has a good adhesion to the substrate as pointed out hereinbefore and a mirror plane film can be obtained.

After an amorphous silicon film having a thickness of about 2 μm has thus been deposited, discharge is stopped and the vessel is evacuated to vacuum. Then, the amorphous silicon film is heat-treated at 250° C. for 15 minutes. Incidentally, in case of an image pickup tube, the thickness of the photoconductive film is ordinarily adjusted to 100 nm to 20 μm. Then, in an argon gas of $3\times10^{-3}$ Torr, antimony trioxide is vacuum-deposited in a thickness of 100 nm as a beam landing layer. The so-formed screen is used as a light-sensitive screen of a vidicon type image pick-up tube. When a white light of 10 luxes is applied under a target-applied voltage of 50 V, the current signal is 600 mA, the dark current is less than 1 mA and the lag is 11% after 3 fields.

EXAMPLE 2

This Example illustrates an embodiment in which the present invention is applied to a light-sensitive screen of a solid-state image pickup device.

Figure 6:
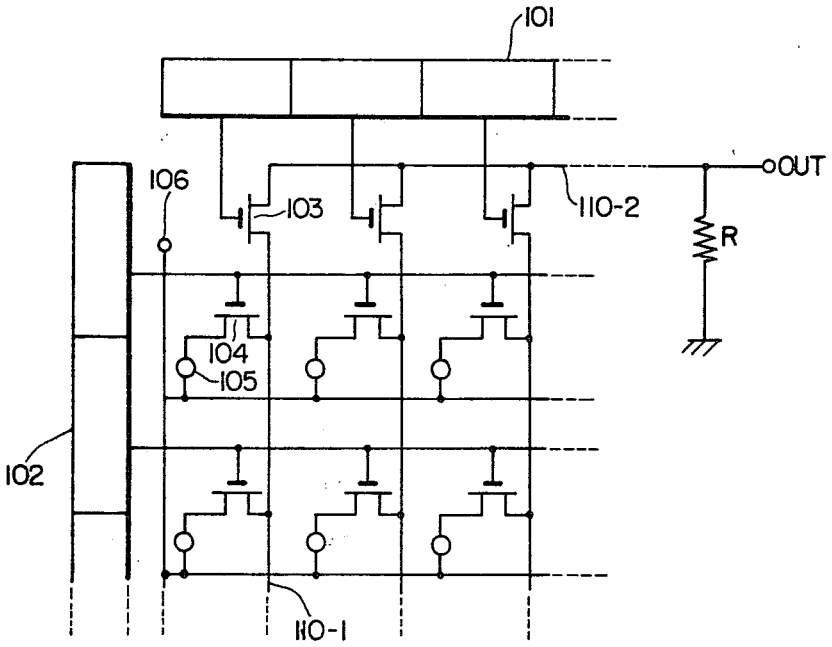
FIG. 6 is a diagram illustrating the principle of the solid-state image pickup device.
Figure 8:
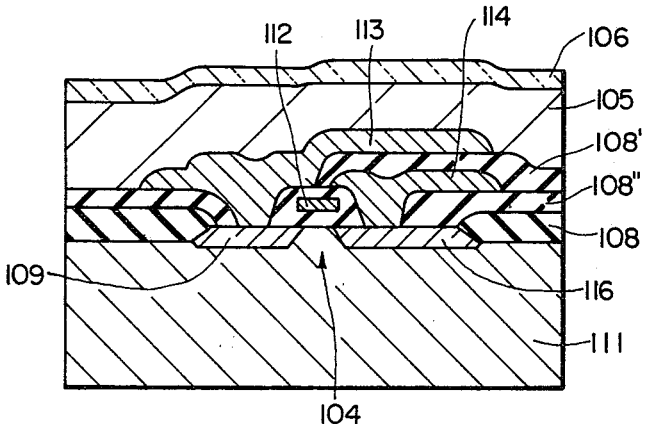
FIG. 8 is a sectional view of main elements of the solid-state image pickup device.

As an instance of the solid-state image pickup device, there can be mentioned an image pickup device comprising a substrate, a scanning circuit formed on the substrate, switches connected to the scanning circuit and a photoconductive film for photoelectric conversion, which is formed on the scanning circuit and switches. In this image pickup device, because of a two-layer structure where the photoelectric conversion element is formed on the scanning circuit and the switches, the degree of integration of picture elements (that is, the resolving power) and the light-receiving ratio are increased. Accordingly, future development of image pickup devices of this type is highly expected. Solid-state image pickup devices of this type are disclosed in, for example, Japanese Patent Application Laid-Open Specification No. 10715/76 (filed on July 5, 1974). FIG. 6 illustrates the principle of this device. In FIG. 6, reference numeral 101 represents a horizontal scanning circuit for opening and closing a horizontal position selecting switch 103, reference numeral 102 represents a vertical scanning circuit for opening and closing a vertical position selecting switch 104, and reference numerals 105 and 106 represent a photoelectric conversion element including a photoconductive film and a power source voltage terminal for driving the photoelectric conversion element, respectively. Reference numerals 110-1 and 110-2 represent signal output lines, and symbol R represents a resistance. FIG. 8 illustrates the sectional structure of the photoelectric conversion region shown in FIG. 6. Reference numerals 104, 105 and 106 represent a vertical switch, a photoconductive film and a transparent electrode, respectively, and reference numerals 108, 108' and 108'' represent insulating films. Reference numerals 111, 112 and 113 represent a semiconductor substrate, a gate electrode and an electrode (for example, Al) kept in ohm contact with one end 109 (diffusion area formed of an impurity of a conductor type different from that of the substrate) of the switch 104, respectively. When an optical image is formed on the photoconductive film through a lens, the value of the resistance of the photoconductive film is changed according to the optical intensity of the optical image and a change of the voltage corresponding to the optical image appears on one end 109 of the vertical switch 104. This change is picked up as an image signal from an output end OUT through the signal output lines 110-1 and 110-2 (see FIG. 6). Incidentally, reference numeral 116 represents an impurity diffusion region having the same conductor type as that of the end 109, which is connected to the signal output line 110-1.

A scanning circuit portion including a switch circuit and the like, which is to be formed on the semiconductor substrate, is prepared according to customary steps adopted for production of semiconductor devices. A thin $SiO_2$ film having a thickness of about 800 Å is formed on a p-type silicon substrate, and an $Si_3N_4$ film having a thickness of about 1400 Å is formed at a predetermined position on the $SiO_2$ film. The $SiO_2$ film is formed according to the customary CVD method and the $Si_3N_4$ film is formed by the $N_2$-flowing CVD method. Then, silicon is locally oxidized in an atmosphere of $H_2$ and $O_2$ at an $H_2/O_2$ ratio of $\frac{1}{8}$ to form an $SiO_2$ layer 108. This method is a method of local oxidation of silicon for separation of elements, which is ordinarily called "LOCOS". The above-mentioned $Si_3N_4$ and $SiO_2$ films are once formed.

Figure 7:
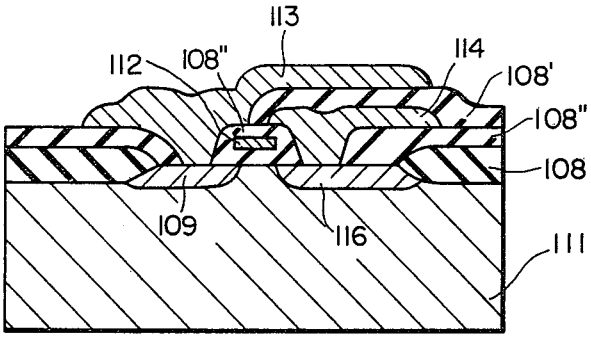
FIG. 7 is a sectional view of a semiconductor substrate of the solid-state image pickup device.

Then, gate region 112 and diffusion regions 109 and 116 are formed from polycrystalline silicon, and an $SiO_2$ film 108'' is formed on these regions. An electrode take-out opening for the impurity region 116 is formed in the $SiO_2$ film 108'' by etching. Al is vacuum-deposited in a thickness of 8000 Å as an electrode 110-1. Furthermore, an $SiO_2$ film 108' having a thickness of 7500 Å is formed, and then, an electrode take-out opening for the impurity region 109 is formed on the region 109 by etching and Al or Mo is vacuum-deposited in a thickness of 1 μm as an electrode 113. The semiconductor substrate prepared through the foregoing steps is illustrated in FIG. 7.

A recombination layer of $Sb_2S_3$ or the like may optionally be formed on the aluminum electrode 113. As the material of this layer, there can further be mentioned $As_2Se_3$, $As_2S_3$ and $Sb_2Se_3$. The thickness should be at least 50 Å and is ordinarily smaller than 5000 Å and preferably smaller than 3000 Å.

The above-mentioned semiconductor device portion can be prepared according to customary steps for preparation of MOSIC.

The semiconductor substrate prepared through the above-mentioned steps is set in a magnetron type sputtering apparatus, and a mixed gas of Ar and hydrogen is used as the atmosphere under $5\times10^{-3}$ Torr. The partial pressure of hydrogen is 10%. Silicon is used as the sputtering target, and reactive sputtering is carried out with an input power of 300 W at a frequency of 13.56 MHz and a hydrogen-containing amorphous silicon film is deposited in a thickness of 500 nm on the semiconductor substrate as shown in FIG. 8. Incidentally, the thickness of the photoconductive film is ordinarily adjusted to 0.2 to 10 μm and preferably to 0.5 to 5 μm. In the so-formed amorphous film, the hydrogen content is 15 atomic %, and the resistivity is $5\times10^{13}\Omega$-cm. Furthermore, the optical forbidden band gap is 1.55 eV and the (peak) 2000/(peak) 2100 ratio is 1.6.

Then discharge is stopped and the vessel is evacuated, and the amorphous silicon film is heat-treated at 250° C. for 15 minutes. A transparent electrode 106 is formed on the amorphous silicon film. Thus, production of the solid-state image pickup device is completed. As the transparent film, there may be used as ultra-thin film of gold or the like and a transparent conductive film of indium oxide, tin oxide or the like which can be formed at low temperatures.

An ohm-contact conductor film is formed on the back face of the semiconductor substrate, and this conductor film is ordinarily earthed through a terminal.

What Is claimed Is:

1. A method of producing an image pickup device, which comprises the steps of forming a hydrogen-containing amorphous silicon layer on a predetermined substrate and heating the amorphous silicon layer at a temperature of from 100° to 300° C., said hydrogen-containing amorphous silicon containing hydrogen in an amount of 5 to 30 atomic % and having an optical forbidden band gap of from 1.30 eV to 1.95 eV, and in the infrared absorption spectrum of the hydrogen-containing amorphous silicon, the component of a wave number of about 2000 $cm^{-1}$ being larger than the component of a wave number of about 2100 $cm^{-1}$.

2. A method of producing an image pickup device according to claim 1, wherein the heating step is carried out at a temperature of from 150° to 300° C.

3. A method of producing an image pickup device according to claim 1 or 2, wherein the step of forming the hydrogen-containing amorphous silicon layer is effected in an atmosphere containing at least a rare gas and hydrogen and the amorphous silicon layer is deposited on the predetermined substrate by sputtering.

4. A method of producing an image pickup device according to claim 1 or 2, wherein the heating step is carried out in vacuum at an absolute pressure of 0.1 Torr or lower.

5. A method of producing an image pickup tube, which comprises the steps of forming a hydrogen-containing amorphous silicon layer on an image pickup tube substrate comprising a light-transmitting substrate and a transparent electrode and heating the hydrogen-containing amorphous silicon layer at a temperature of from 100° to 300° C., said hydrogen-containing amorphous silicon containing hydrogen in an amount of 5 to 30 atomic % and having an optical forbidden band gap of from 1.30 eV to 1.95 eV, and in the infrared absorption spectrum of the hydrogen-containing amorphous silicon, the component of a wave number of about 2000 $cm^{-1}$ being larger than the component of a wave number of about 2100 $cm^{-1}$.

6. A method of producing a solid-state image pickup device, which comprises the steps of forming a hydrogen-containing amorphous silicon layer on a semiconductor substrate including at least an impurity region and a first electrode having contact with at least a part of the impurity region and heating the hydrogen-containing amorphous silicon layer at a temperature of from 100° to 300° C., said hydrogen-containing amorphous silicon containing hydrogen in an amount of 5 to 30 atomic % and having an optical forbidden band gap of from 1.30 eV to 1.95 eV, and in the infrared absorption spectrum of the hydrogen-containing amorphous silicon, the component of a wave number of about 2000 $cm^{-1}$ being larger than the component of a wave number of about 2100 $cm^{-1}$.

* * * * *